United States Patent [19]

Stoughton

[11] Patent Number: 4,688,548

[45] Date of Patent: Aug. 25, 1987

[54] HOLDER APPARATUS FOR A FIREBACK

[75] Inventor: Donald B. Stoughton, Paoli, Pa.

[73] Assignee: The Country Iron Foundry, Paoli, Pa.

[21] Appl. No.: 841,592

[22] Filed: Mar. 20, 1986

[51] Int. Cl.[4] ..... F24B 13/00

[52] U.S. Cl. ..... 126/298; 126/120; 126/130; 126/152 B; 126/201; 160/368 R; 160/DIG. 9

[58] Field of Search ..... 126/120, 141, 138, 130, 126/164, 152 B, 152 R, 298, 202, 153, 168, 201; 160/368 R, DIG. 9; 248/DIG. 11, DIG. 12, 188

[56] References Cited

U.S. PATENT DOCUMENTS

| | | | |
|---|---|---|---|
| 115,827 | 6/1871 | Davis | 126/153 |
| 863,114 | 8/1907 | Stevens | 126/298 X |
| 1,547,857 | 7/1925 | Clough et al. | 126/298 X |
| 2,578,564 | 12/1951 | Love et al. | 126/298 |
| 4,271,817 | 6/1981 | Thompson | 126/298 |
| 4,526,159 | 7/1985 | Vroome | 126/298 X |

FOREIGN PATENT DOCUMENTS

| | | | |
|---|---|---|---|
| 2909345 | 10/1979 | Fed. Rep. of Germany | 126/298 |
| 13438 | of 1902 | United Kingdom | 126/153 |

*Primary Examiner*—Randall L. Green

*Attorney, Agent, or Firm*—Woodcock Washburn Kurtz Mackiewicz & Norris

[57] ABSTRACT

An apparatus for supporting a fireback without the need for additional support from a wall or other structure. The apparatus consists of two support bases, each with a flat upper surface including two buttresses separated by a gap, arising perpendicularly therefrom. The fireback is placed in the gap between the buttresses and held ajar in a generally upright position. The invention includes insertable wedges which permit the varying of the gap, and therefore the angle of incidence of the fireback relative to the vertical plane. The invention maximizes the full depth of the fireplace, as well as the light reflection, heat radiation, and ornamental qualities of the fireback.

4 Claims, 4 Drawing Figures

HOLDER APPARATUS FOR A FIREBACK

BACKGROUND OF THE INVENTION

The present invention relates, in general, to firebacks and, in particular, to a novel holder for firebacks. A fireback is a metallic shield which is placed at the back wall of a fireplace. Because of its metallic nature, the fireback serves three purposes. First, it is ornamental or decorative and covers the brick or stone back wall of the fireplace. Secondly it helps to radiate heat forward out of the fireplace. Thirdly, because it is metallic, the fireback reflects the light of the fire forward, thereby maximizing its luminance qualities.

In general, firebacks have been mounted to the rear wall of a fireplace with the aid of screws, braces, or other attachment devices. This inevitably requires drilling or chiseling through brick or other hard stone materials. The attachment of a fireback has been further complicated when the rear wall of the fireplace slants forward toward the hearth. In such installations because the firebacks are not elevated properly, most of their decorative, heat radiation and luminance qualities are not optimized.

It would be desirable to provide an improved means for mounting a fireback. It would further be desirable to provide such a mounting means for fireplaces having both vertical and forward sloping rear walls.

The present invention successfully solves many of the problems associated with prior fireback mounting devices. In accordance with the present invention, an apparatus for holding a fireback upright in either a vertical or sloping fireplace, without the need for bolts, screws or any other wall attachment features is shown. The apparatus contains features which allow the adjustment of the angle of incidence of the fireback relative to the rear wall of the fireplace. Finally, the apparatus elevates the fireback with respect to the hearth thereby maximizing its decorative, heat radiating and light reflection qualities.

SUMMARY OF THE INVENTION

In accordance with the present invention an apparatus for holding a fireback at any desired angle against the rear wall of a fireplace, without the need for anchors or other supports on the wall is provided. In accordance with the present invention, the fireback holder includes at least two generally longitudinal support bases which raise the fireback with respect to the hearth for better viewing of the design, maximum heat radiation and luminance, while maintaining the full depth of the fireplace. Each support base has an upper surface with two protruding buttresses separated by a gap, the buttresses arising perpendicularly from the upper surface. The fireback is placed transversely across the support bases and is situated within the gap between the two perpendicular buttresses on each support base at which it is held in a generally upright position. The upper surface of the support bases includes an aperture in the region of the gap. The fireback holder further includes a plurality of insertable wedges mateable with the apertures in the support bases which may be placed between the two protruding buttresses on each base, thereby allowing for the adjustment of the angle of incidence of the fireback with respect to the vertical plane and also restraining the fireback in a generally vertical position.

In the preferred embodiment of the present invention, holes in the upper surface of the fireback holder support bases are preferably provided for holding the rear legs of andirons thereby adding stability to both the support bases and to the fireback mounted thereon. Alternatively, the support bases can be placed away from the andiron, or grate legs. In either embodiment, the protruding buttresses preclude the fireback from falling forward into the fire. In accordance with the the preferred embodiment of the present invention, several holes are present on the upper surface of the support bases which permit the variable adjustment of the andirons, either toward or away from the fireback, while maintaining the generally upright position of the fireback.

BRIEF DESCRIPTION OF THE DRAWINGS

The present invention will be more fully understood by reference to the drawing in which.

DESCRIPTION OF THE PREFERRED EMBODIMENT

Figure 1:
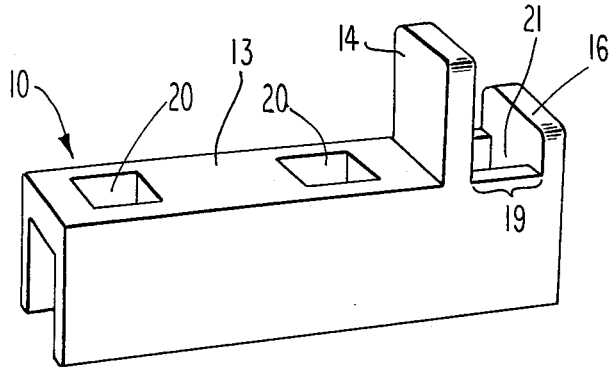
FIG. 1 is a side perspective view of one of the support bases of the fireback holder apparatus of the present invention.
Figure 2:
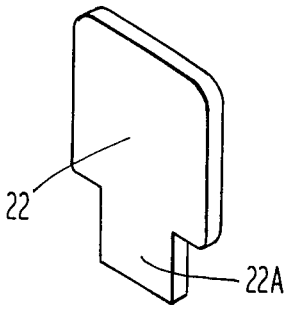
FIG. 2 is a perspective view of an insertable wedge which is used in conjunction with the support bases of the type shown in FIG. 1 to support a fireback.
Figure 3:
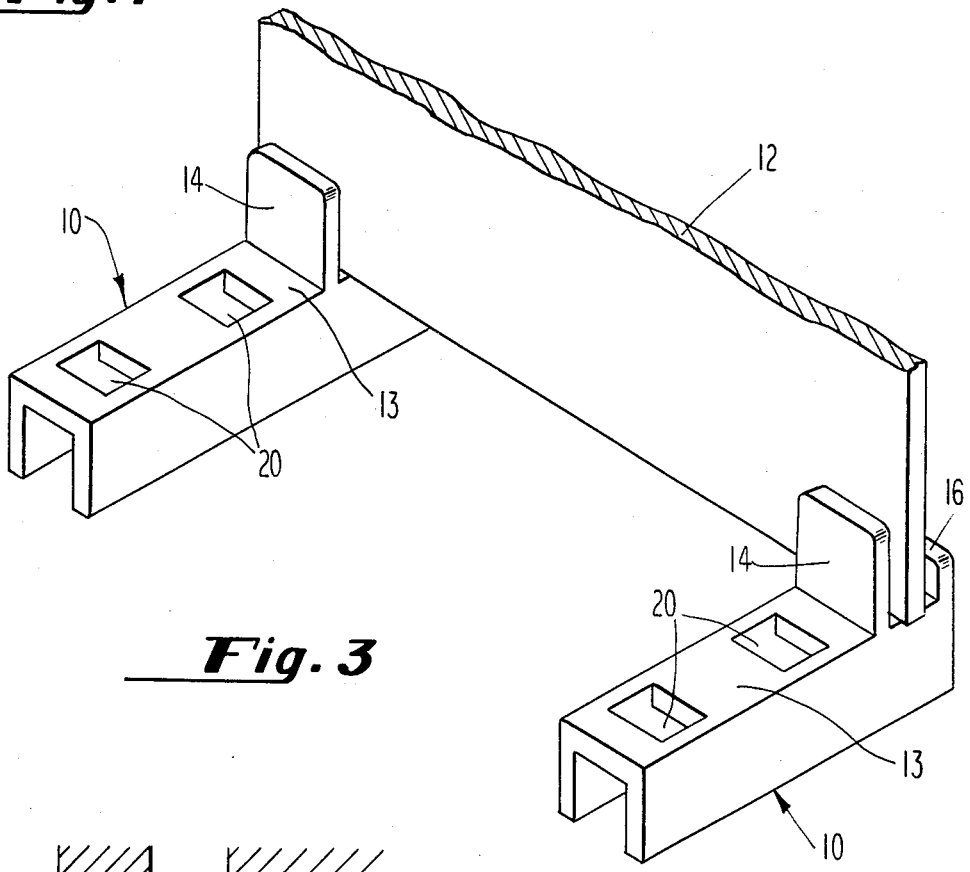
FIG. 3 is a front perspective view of the fireback holder apparatus of the present invention which illustrates the fireback held upright by two support bases of the type shown in FIG. 1.

Referring now to FIGS. 1–3, the preferred embodiment of the present invention will be described. As shown in FIG. 3, the fireback holder of the present invention includes at least two generally longitudinal support bases 10. Each support base 10 (FIG. 1) comprises a rectangular block constructed of a metal such as cast iron or an iron alloy with a preferably flat upper surface 13 containing two supporting buttresses 14 and 16 at one exreme thereof. The buttresses 14 and 16 are of unequal height, buttress 16 being shorter than buttress 14. The buttresses 14 and 16 protrude perpendicularly out of the plane of the upper surface 13 and separated by a gap 19. In the preferred embodiment, a fireback 12 is ultimately placed transversely across each of the support bases 10 in the gap 19 between the two protruding buttresses 14 and 16 on each support base 10. The fireback 12 is held in a generally upright position between the two protruding buttresses. The support bases 10 elevate the fireback 12, for example, about 2.5 inches above the hearth in order to maximize the decorative, heat radiation and luminance qualities of the fireback. As shown in FIG. 1, in the region of the gap 19 on the upper surface 13 of each support base 10 is an aperture 21.

The invention further provides, as shown in FIG. 2, an insertable wedge 22. At least two such wedges are provided. Each of the wedges 22 includes a tongue portion 22A which is designed to be placed within the aperture 21 in the gap region 19 of the support bases 10 between the two protruding buttresses 14 and 16. The insertion of the wedges 22 thus varies the width of the gap 19.

As shown in FIG. 3, in operation, the two longitudinal support bases are disposed generally parallel to each other and separated by the length of the fireback 12. The fireback 12 is situated transversely across the respective support bases 10 and positioned between the buttresses 14 and 16 of each support base. The fireback 12 is positioned generally vertically and may be restrained in that position by the buttresses 14 and 16 without the need for the insertion of wedges 22 such as shown in FIG. 2. Such a mounting arrangement is particularly useful in a fireplace having a substantially vertical rear wall.

Figure 4:
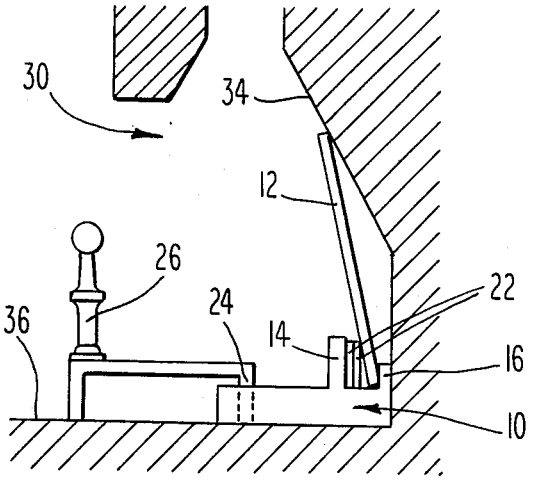
FIG. 4 is a side elevational view of the fireback holder apparatus, which illustrates the fireback held in a generally upright position in a forward sloping fireplace.

As shown in FIG. 4, however, the fireback holder of the present invention may be used in fireplaces having generally forward sloping rear walls. As shown in FIG. 4, the fireplace 30 may include a forward sloping rear wall 34 which has an angle of incidence with respect to the hearth 36 which is not perpendicular. In such an arrangement, the wedges 22 shown in FIG. 2 are particularly useful in maintaining fireback 12 against the forward sloping rear wall 34 of the fireplace 30. As the gap size decreases with the insertion of a wedge 22 into aperture 21, the angle of incidence of the fireback 12 with respect to the vertical plane may be decreased. Accordingly, as shown in FIG. 4, when the fireback 12 is placed in the gap containing a plurality of wedges 22, its angle of incidence relative to the vertical plane can be further adjusted. This feature allows for the accommodation of a variety of forward sloping fireplaces as shown in FIG. 4. Moreover, as shown in FIG. 3, the apparatus of the present invention can also accommodate a non-sloping fireplace.

In accordance with the preferred embodiment of FIG. 1, each support base 10 may contain one or more holes 20 along the flat upper surface 13 of its body length. As shown in FIG. 4, the holes 20 accommodate the legs 24 of an andiron or grate 26. The andiron or grate 26 is a metal apparatus which holds the logs in a fireplace. The holes 20 in the support bases 10 provide a variety of options in the positioning of the andirons 20 or grate with respect to the hearth 36. This feature allows the user to vary the distance of the fireback 12 from the back wall 34 of the fireplace to the front of the hearth without affecting the generally vertical position of the fireback. While this feature adds stability to the arrangement, its inclusion is not necessary to hold the fireback in a generally upright position.

While a single embodiment of the present invention has been shown and described, other embodiments are possible and are to be included within the spirit and scope of the appended claims.

What is claimed is:

1. A holder for supporting a fireback in a fireplace having a forward sloping rear wall, comprising:

at least two generally longitudinal support bases, each having an upper surface, each of said support bases further including:

a first buttress extending vertically perpendicular from said upper surface; and a second buttress extending vertically perpendicular from said surface and spaced from said first buttress, and forming a gap therebetween;

an aperture in the upper surface of each of said support bases in the region of said gap; and insertable metal wedges adapted to mate within said apertures between said buttresses thereby allowing the narrowing of said gap for restraining a fireback in a generally upright position.

2. The holder for supporting a fireback as recited in claim 1 in which:

said buttresses are of sufficient height with respect to said upper surface to maintain the fireback in a generally upright position when said fireback is disposed within said gap.

3. A holder for supporting a fireback as recited in claim 1 in which each of said support bases further comprises:

at least one hole in said upper surface thereof to accommodate the legs of an andiron therein.

4. In a fireplace having a shallow depth and a substantially forward sloping rear wall, a fireback, and a pair of andirons, the improvement in combination therewith comprising:

a pair of parallel bases for supporting said fireback against said rear wall in a substantially upright position, each of said bases including an upper surface, first and second buttresses protruding upwardly from said upper surface spaced apart thereby defining a transverse gap within which said fireback is positioned relative to said rear wall, a first hole in said upper surface within said gap, and at least one other hole in said upper surface adapted to receive a respective one of said pair of andirons; and wedge means adapted to be mounted within said gap for adjusting the position of said fireback relative to said rear wall and thereby utilizing a maximum portion of said shallow depth.

* * * * *